US006497124B2

(12) United States Patent
Lin

(10) Patent No.: US 6,497,124 B2
(45) Date of Patent: Dec. 24, 2002

(54) DYEING MACHINE WITH DOUBLE DYE SOLUTION SPREADING ARRANGEMENT

(76) Inventor: Chin Chuan Lin, No. 19, Her-Meei Lane, Section 2, Nan-Kaan Road, Lu-Jwu Hsiang, tao-Yuan Hsien (TW)

( * ) Notice: Subject to any disclaimer, the term of this patent is extended or adjusted under 35 U.S.C. 154(b) by 0 days.

(21) Appl. No.: 09/871,818

(22) Filed: Jun. 4, 2001

(65) Prior Publication Data

US 2002/0002848 A1 Jan. 10, 2002

(30) Foreign Application Priority Data

Jul. 7, 2000 (TW) ..... 89211761 U

(51) Int. Cl.[7] ..... D06B 3/28
(52) U.S. Cl. ..... 68/178
(58) Field of Search ..... 68/177, 178, 181 R

(56) References Cited

U.S. PATENT DOCUMENTS 3,982,411 A * 9/1976 Kreitz ..... 68/177
4,083,208 A * 4/1978 Ekstroem ..... 68/178 X
5,440,771 A * 8/1995 Georgantas ..... 68/178 X

FOREIGN PATENT DOCUMENTS

JP 26979 * 1/1990 ..... 68/177

* cited by examiner

*Primary Examiner*—Philip Coe
(74) *Attorney, Agent, or Firm*—Troxell Law Office PLLC

(57) ABSTRACT

A dyeing machine comprises a roller mechanism, a nozzle mechanism having two nozzles, a fabric guide mechanism, wherein fabric is dyed twice. The degree of impingement on fabric is predetermined with respect to respective specific type of fabric, resulting in a more uniform dyeing as well as a shortening of process time and solution cycle. Moreover, the fabric guide tube may be upwardly, horizontally, or downwardly adjusted in order to obtain a better quality of respective specific fabric.

7 Claims, 9 Drawing Sheets

DYEING MACHINE WITH DOUBLE DYE SOLUTION SPREADING ARRANGEMENT

BACKGROUND OF THE INVENTION

1. Field of the Invention

The present invention relates to a dyeing machine with double dye solution spreading arrangement.

2. Description of Related Art

Conventionally, dyeing is performed in a high temperature environment. Also, the quality of fabric is mainly affected by dye solution (i.e., dye solved in water) spreading, soaking, and fabric guide. In general, the dyeing arrangement of one specific fabric is different from the other one. In detail, firstly with respect to dye solution spreading, a large low pressure smooth dye solution is required in order to minimize the impinging effect of dye solution on the processed high quality fabric, otherwise it may cause crack or the like. To the contrary, a strong quick dye solution is required to spread on fabric having constituents such as polyester or the like in order to effectively flatten the surface thereof, thus preventing crack or the like. Secondly with respect to socking, a plurality of times of soaking may obtain a better dyeing quality as compared to single soaking. Thirdly with respect to fabric guide, an impinging on thin loosely textured fabric is preferred. Also, an loosening rather than impinging on cotton-based fabric is preferred. Moreover, a squeezing is required for manufacturing a wrinkled fabric.

A conventional dyeing machine comprises only a single nozzle. It is disadvantageous for poor uniformity and relatively long dyeing time. Further, with respect to dye solution spreading, a large strong dye solution is fed from pump. A sufficient time for spreading dye solution on fabric is not possible. Thus, such strong impingement on fabric may adversely affect the quality thereof. This is not suitable for high quality fabric. With respect to fabric guide, the arrangement of fabric guide (e.g., guide angle) is fixed, i.e., not readily adapted to particular requirements of specific type of fabric. Thus the application is limited.

Thus, it is desirable to provide an improved dyeing machine in order to overcome the above drawbacks of prior art.

SUMMARY OF THE INVENTION

It is an object of the present invention to provide a dyeing machine, wherein fabric is dyed twice by the double nozzle arrangement resulting in a more uniform dyeing as well as a shortening of process time and solution cycle.

In one aspect of the present invention, the fabric guide tube may be upwardly, horizontally, or downwardly adjusted in order to obtain a better quality of respective specific fabric. For example, when fabric guide tube is rotated downwardly to form a V, fabric may be squeezed in fabric guide tube. When fabric guide tube is rotated upwardly to form an A, fabric may be impinged by dye solution in the fabric guide tube. Moreover, fabric guide tube may be slightly adjusted horizontally to loosen fabric.

In another aspect of the present invention, the silicone strips are capable of significantly reducing the slippage between roller and fabric for preventing potential breakage of fabric from occurring. This provision is particularly suitable to fabric having short yarn. In contrast, it is possible to detach silicone strips from roller, thus exposing the smooth surface of roller. This tolerates a large slippage between roller and fabric. This configuration is particularly suitable to fabric having long yarn.

The above and other objects, features and advantages of the present invention will become apparent from the following detailed description taken with the accompanying drawings.

DETAILED DESCRIPTION OF THE PREFERRED EMBODIMENTS

Figure 1A:
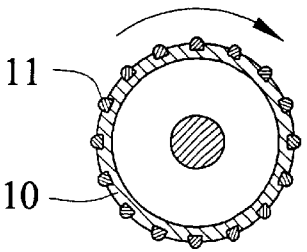
FIG. 1A is a sectional view of roller in FIG. 1.
Figure 1:
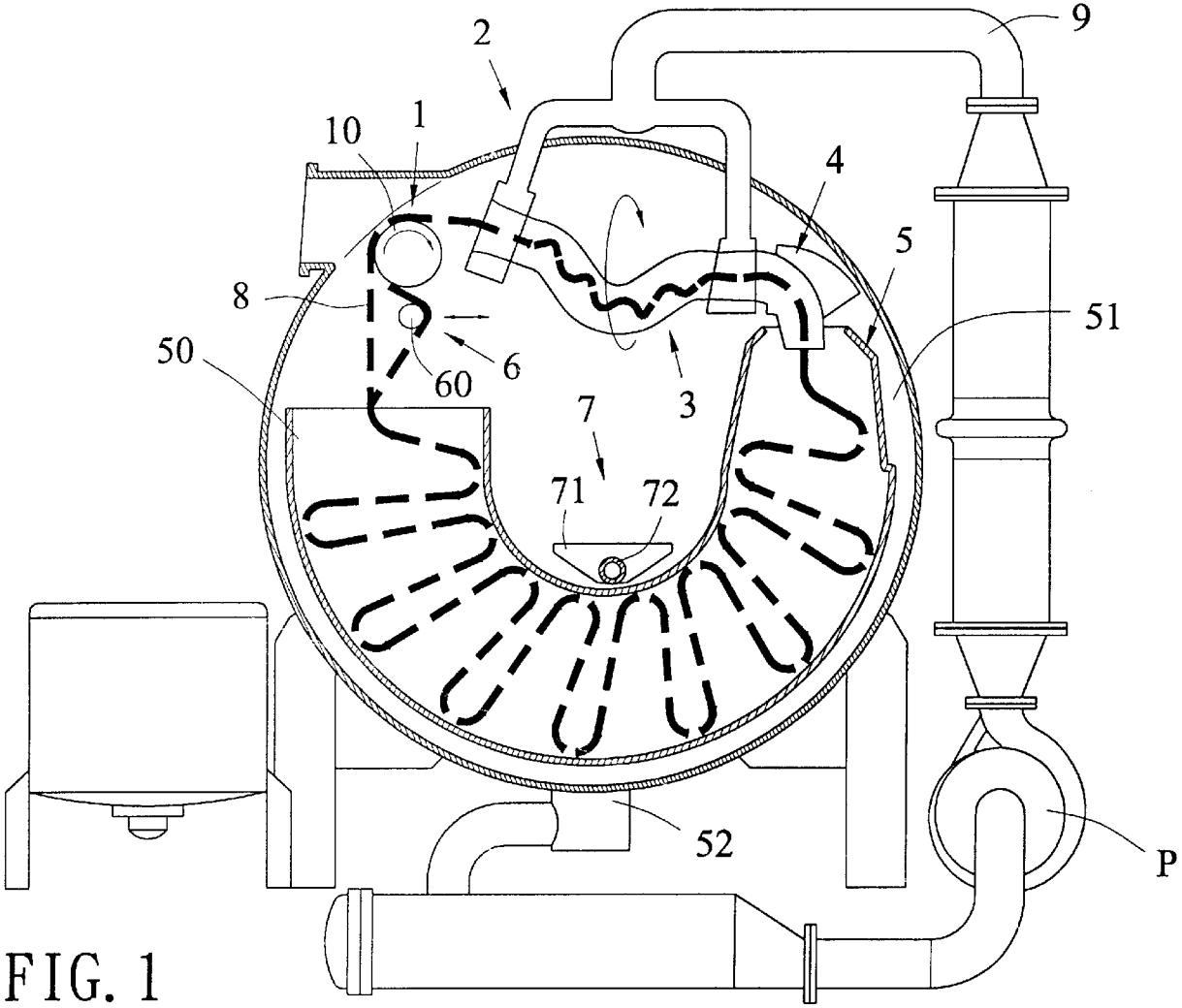
FIG. 1 is a schematic side view in part section of a first preferred embodiment of dyeing machine with double dye solution spreading arrangement according to the invention.

Referring to FIG. 1, there is shown a dyeing machine constructed in accordance with the invention. The dyeing machine comprises a roller mechanism 1, a nozzle mechanism 2, a fabric guide mechanism 3, a fabric vibration mechanism 4, a fabric separation mechanism 5, a tension adjustment mechanism 6, and a bubble separation mechanism 7. Each of above mechanisms is detailed below. An endless fabric 8 is conveyed from a source (not shown) to nozzle mechanism 2 by roller mechanism 1. Fabric 8 is dyed by jetted dye solution from nozzle mechanism 2 and by the rotation of fabric guide mechanism 3. Then the dyed fabric 8 is sent to fabric vibration mechanism 4 and fabric separation mechanism 5 for separating fabric from dye solution. Thus fabric 8 is folded to sent to fabric channel 50 by vibration. Also, the separated dye solution is directed to a storage 51. Dye solution may be outputted to inlet 52 of pump P prior to pumping to nozzle mechanism 2 again through supply line 9. This is a cycle of dye solution. Tension adjustment mechanism 6 comprises an adjustment roller 60 for adjusting the tension between fabric 8 and roller mechanism 1. Bubble separation mechanism 7 consists of a bubble reservoir 71 and a bubble outlet 72. Bubble is automatically directed to bubble reservoir 71, thus separating fabric 8 from bubble. This can prevent fabric 8 from being polluted by bubble or prevent other irregularities from occurring.

Figure 2:
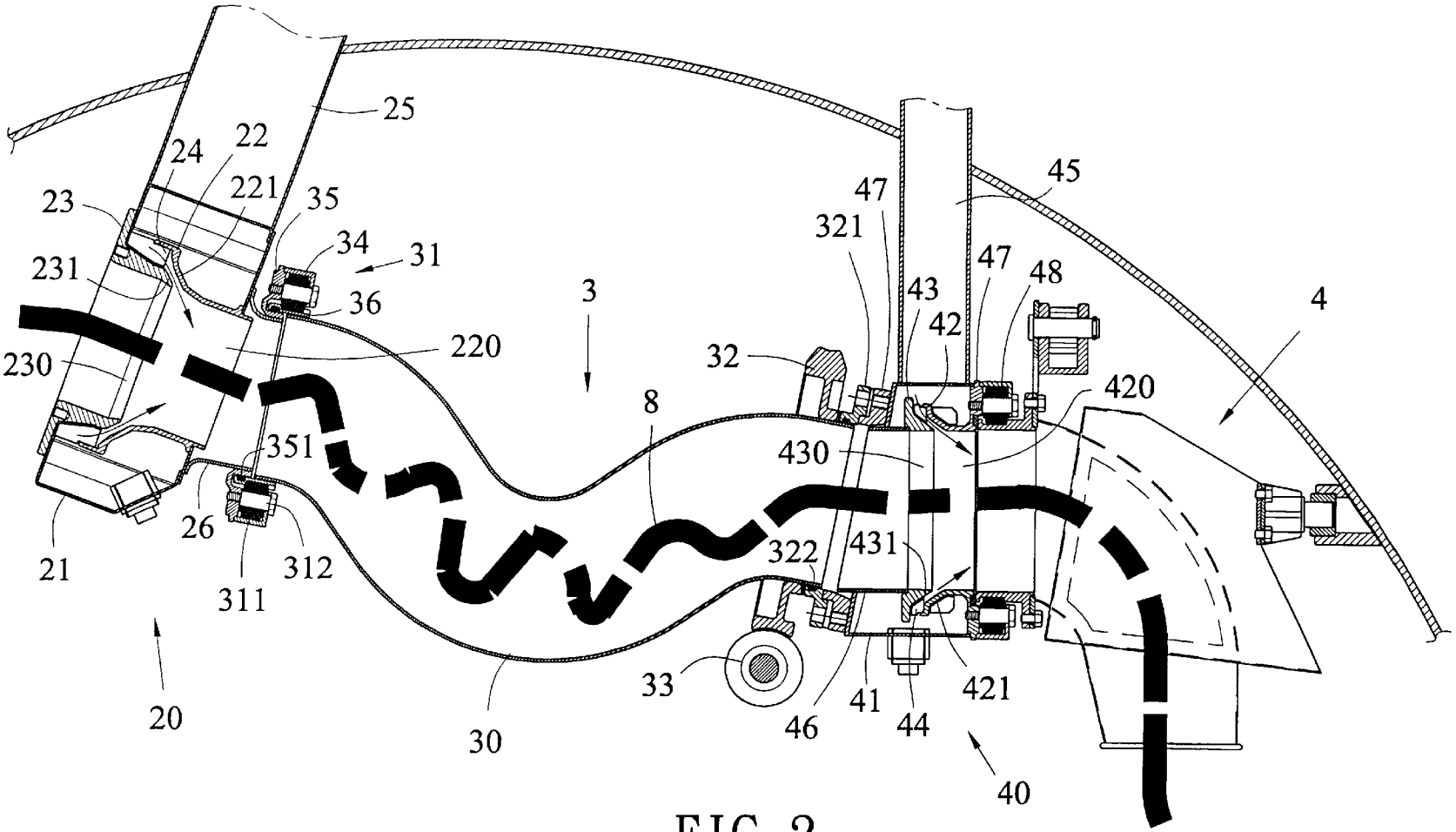
FIG. 2 is an enlarged view of FIG. 1 nozzle mechanism and fabric guide mechanism.

Referring to FIGS. 1A and 2, roller mechanism 1 comprises a roller 10 formed of stainless steel. A plurality of equally spaced detachable silicone strips 11 are mounted around roller 10. Silicone strips 11 may significantly reduce the slippage between roller 10 and fabric 8 for preventing potential breakage of fabric 8 from occurring. Thus, this provision is particularly suitable to fabric having short yarn. In contrast, it is possible to detach silicone strips 11 from roller 10, thus exposing the smooth surface of roller 10. This tolerates a large slippage between roller 10 and fabric 8. Thus, this configuration is particularly suitable to fabric having long yarn. Nozzle mechanism 2 is configured to have two nozzles (e.g., front nozzle device 20 and rear nozzle device 40). Both nozzle devices 20 and 40 have one end coupled to a common outlet of supply line 9, i.e., dye solution is distributed to both nozzle devices 20 and 40. As to front nozzle device 20, it comprises a nozzle seat 23 provided at end portion of the front nozzle device 20, a nozzle tube 22 having a cone-shaped section 221 connected with the nozzle seat 23, a high pressure chamber 21 enclosing the whole circumference of the nozzle tube 22 and a nozzle 24, formed between the nozzle seat 23 and the nozzle tube 22, having a cone-shaped member 231 by securing the front nozzle seat 23 to a solution tube 25. High pressure chamber 21 is coupled to solution tube 25 which is further coupled to rear nozzle device 40. Dye solution fed from solution tube 25 to nozzle 24 is further pressurized through high pressure chamber 21 in order to spread on fabric 8 coming from guide hole 230 to pipe 220. This is a first jet stream of dye solution. A joint 26 is coupled between high pressure chamber 21 and fabric guide mechanism 3. Similarly, rear nozzle device 40 comprises a nozzle seat 43 provided at end portion of the rear nozzle device 40, a nozzle tube 42 having a cone-shaped section 421 connected with the nozzle seat 43, a high pressure chamber 21 enclosing the whole circumference of the nozzle tube 42 and a nozzle 44, formed between the nozzle seat 43 and the nozzle tube 42, having a cone-shaped member 431 by securing the rear nozzle seat 43 to a solution tube 45. High pressure chamber 41 is coupled to solution tube 45 which is further coupled to front nozzle device 20. Dye solution fed from solution tube 45 to nozzle 44 is further pressurized through high pressure chamber 41 to spread on fabric 8 coming from guide hole 430 to pipe 420. This is a second jet stream of dye solution. Hence, fabric 8 is dyed twice, resulting in a more uniform dyeing as well as a shortening of process time and solution cycle. Moreover, a joint 46 and a flange seat 47 are coupled to the sides of high pressure chamber 41 respectively. A fixing seat 422 is provided at nozzle tube 42 for fastening to a rear bearing 48 of fabric vibration mechanism 4. Fabric guide mechanism 3 comprises a bent fabric guide tube 30, a front bearing 31, a joint 36 coupled to front nozzle device 20, a rear toothed wheel 32, a flange 321, and a shaft 33 for rotating the toothed wheel 32. Thus, it is possible to adjust the orientation of fabric guide tube 30 when a specific fabric is dyed, resulting in a better quality of fabric. As shown in FIG. 2, fabric guide tube 30 is substantially shaped as V. This may squeeze the fabric during the fabric guide process. Flange 321 is threadedly secured to flange seat 47. A sealing 322 is provided in flange 321. In the front bearing 31, a screw 312 is driven through bearing housing 34 containing a plurality of rollers for securing the bearing housing 34 to plate 35. Plate 35 is fixed to joint 26. A second sealing 351 is provided in joint 36. This forms a rotational mechanism.

Figure 3:
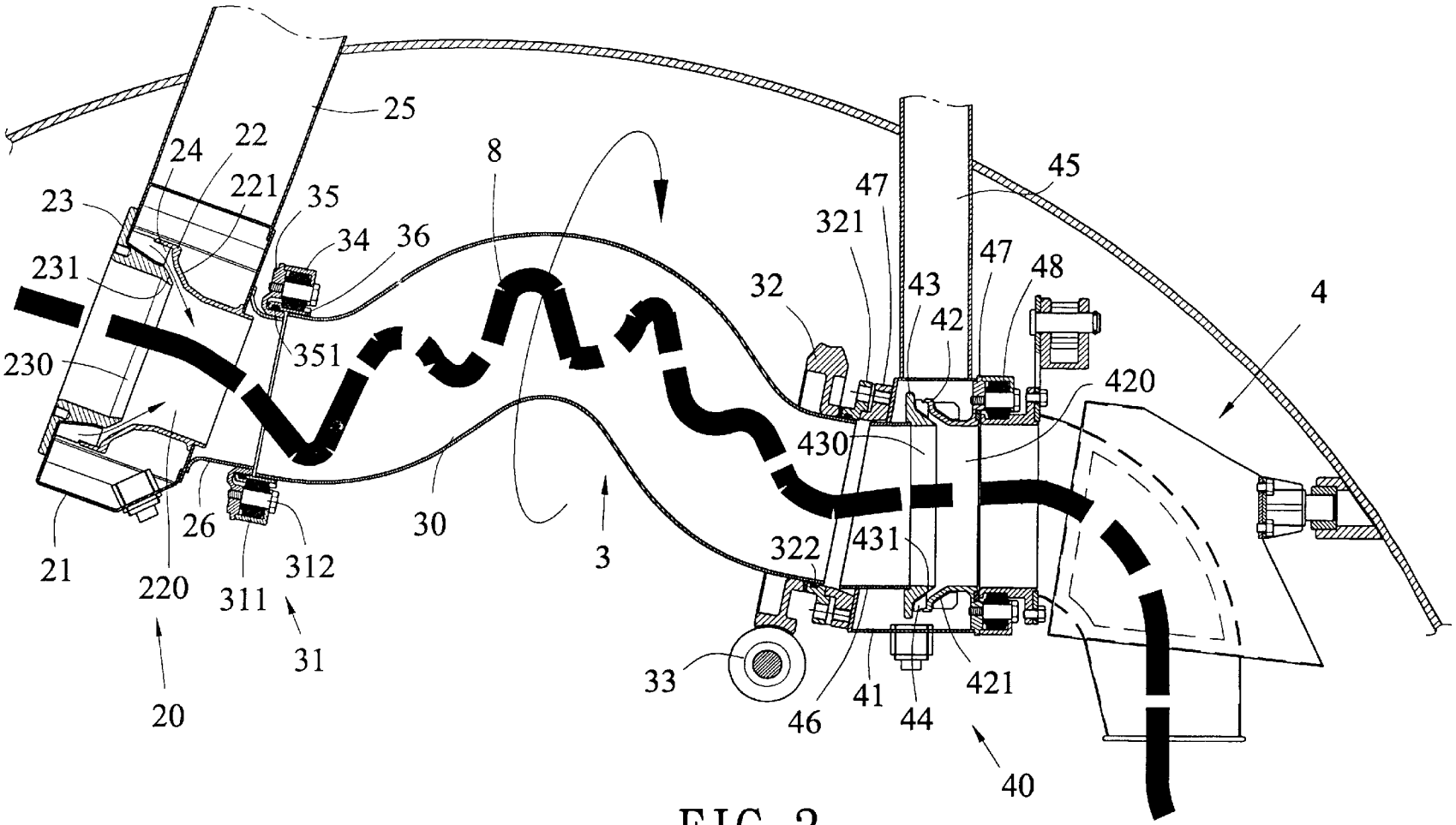
FIG. 3 is a view similar to FIG. 2 where fabric guide tube mechanism is adjusted to form a gable shape.
Figure 4:
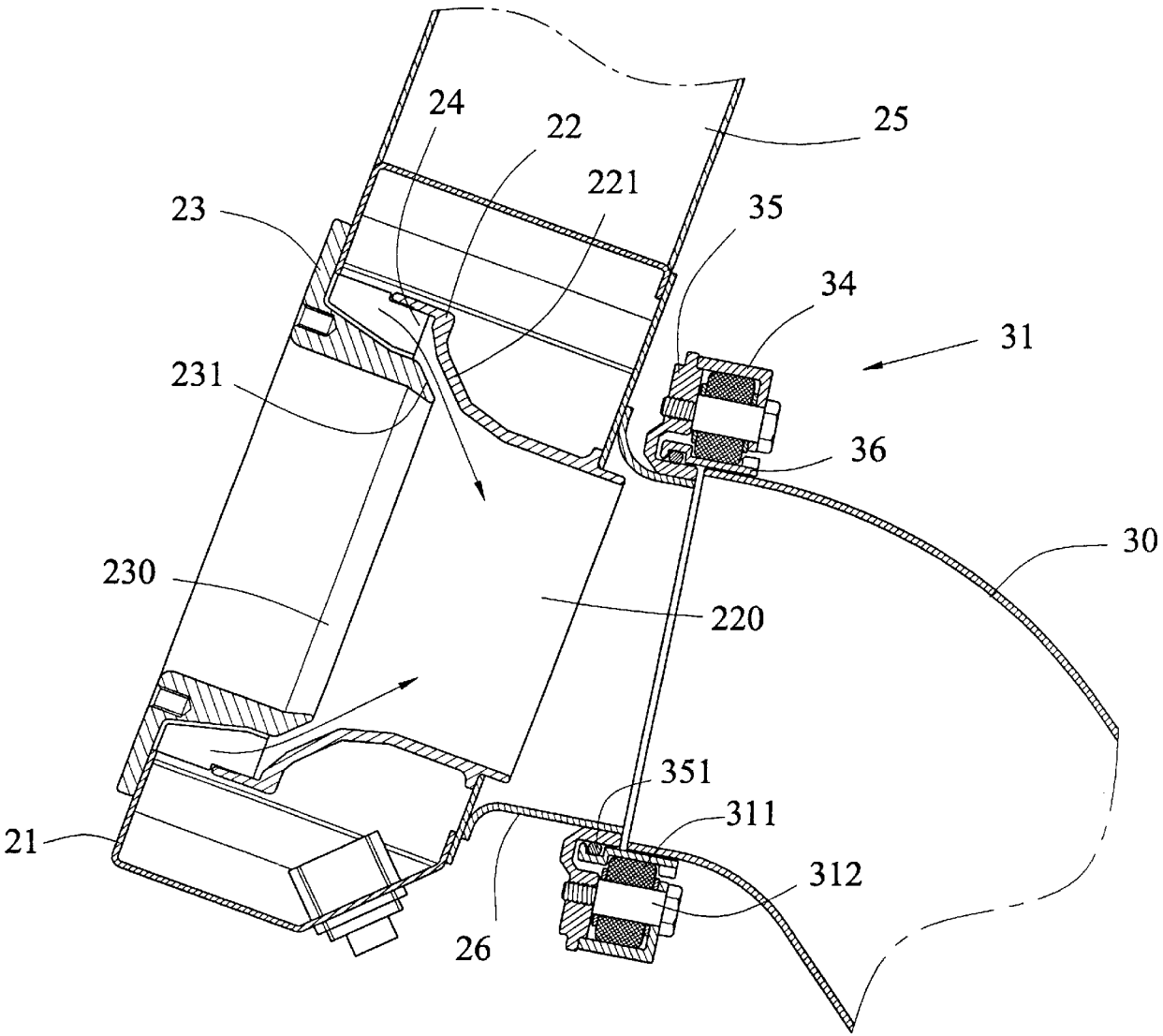
FIG. 4 is a sectional view of a front nozzle device shown in FIG. 2.
Figure 5:
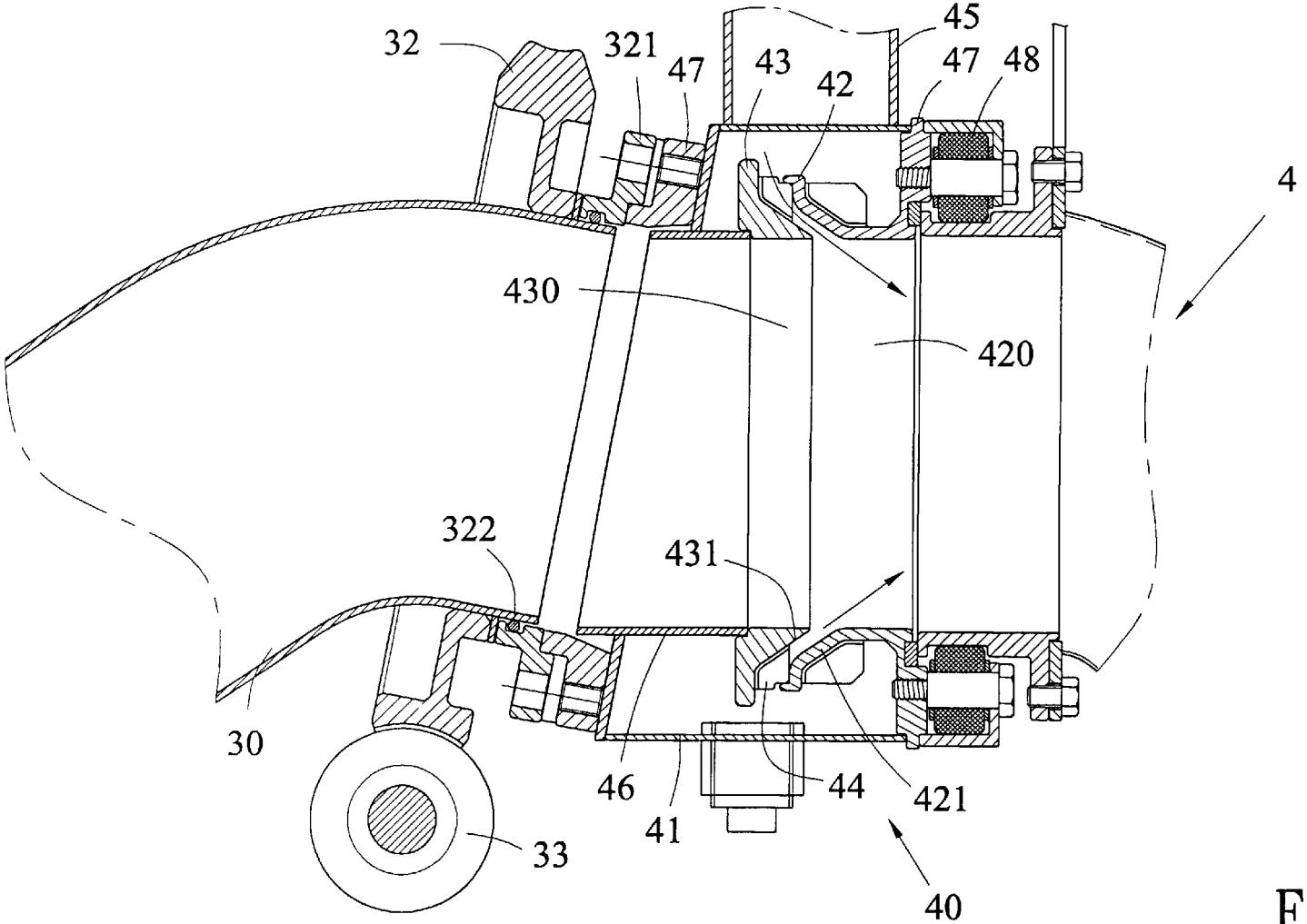
FIG. 5 is a sectional view of a rear nozzle device shown in FIG. 2.
Figure 6:
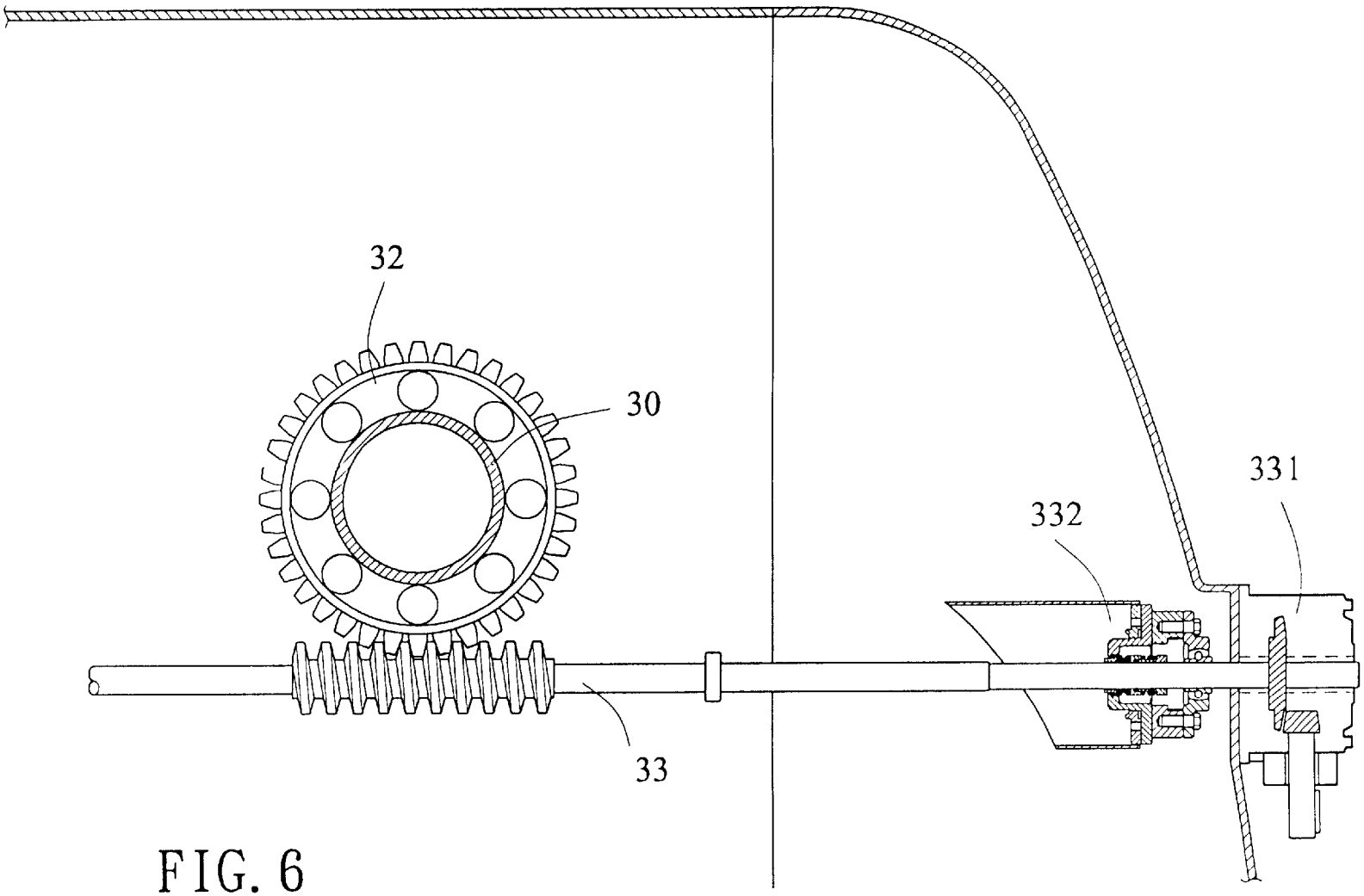
FIG. 6 is a sectional view taken along line A—A of FIG. 2 where transmission mechanism is mounted in fabric guide tube mechanism.
Figures 7A, 7B, 7C:
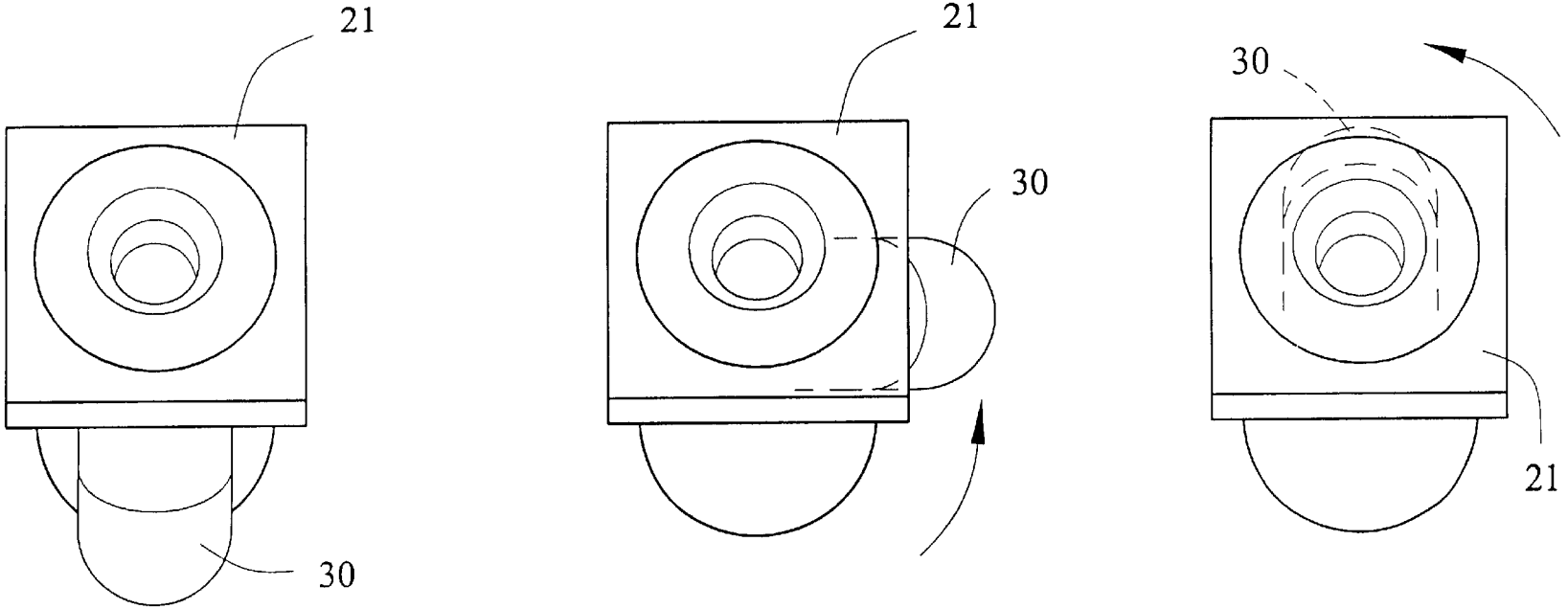
FIG. 7A is side view schematically showing the upward adjustment of fabric guide tube.
FIG. 7B is view similar to FIG. 7A where fabric guide tube is horizontally adjusted.
FIG. 7C is view similar to FIG. 7A where fabric guide tube is downward adjusted.

Referring to FIG. 3, where fabric guide tube 30 is rotated upward by a transmission mechanism to form a gable shape. Also, FIG. 4 is a sectional view of the front nozzle device 20. FIG. 5 is a sectional view of the rear nozzle device 40. FIG. 6 is a sectional view taken along line A—A of FIG. 2 where transmission mechanism is mounted in fabric guide tube 30. Toothed wheel 32 is driven by shaft 33 through speed reduction device 331 and bearing seat 332. Thus the orientation (e.g., angle) of fabric guide tube 30 may be suitably adjusted. FIGS. 7A, 7B and 7C are side views schematically showing the upward, horizontal, and downward adjustment of fabric guide tube 30 respectively. These adjustments of fabric guide tube 30 are desirable to obtain a better quality of respective specific fabric. For example, when fabric guide tube 30 is rotated downwardly to form a V, as shown in FIGS. 2 and 7A, fabric may be squeezed in fabric guide tube 30. This is particularly applicable to knitting in which wrinkles are required to form thereon. Similarly, when fabric guide tube 30 is rotated upwardly to form an A, as shown in FIGS. 3 and 7C, fabric may be impinged by solution in fabric guide tube 30. This is particularly applicable to thin loosely textured fabric. Also, fabric guide tube 30 may be slightly adjusted horizontally, as shown in FIG. 7B, to loosen fabric such as cotton-based one.

Figure 8:
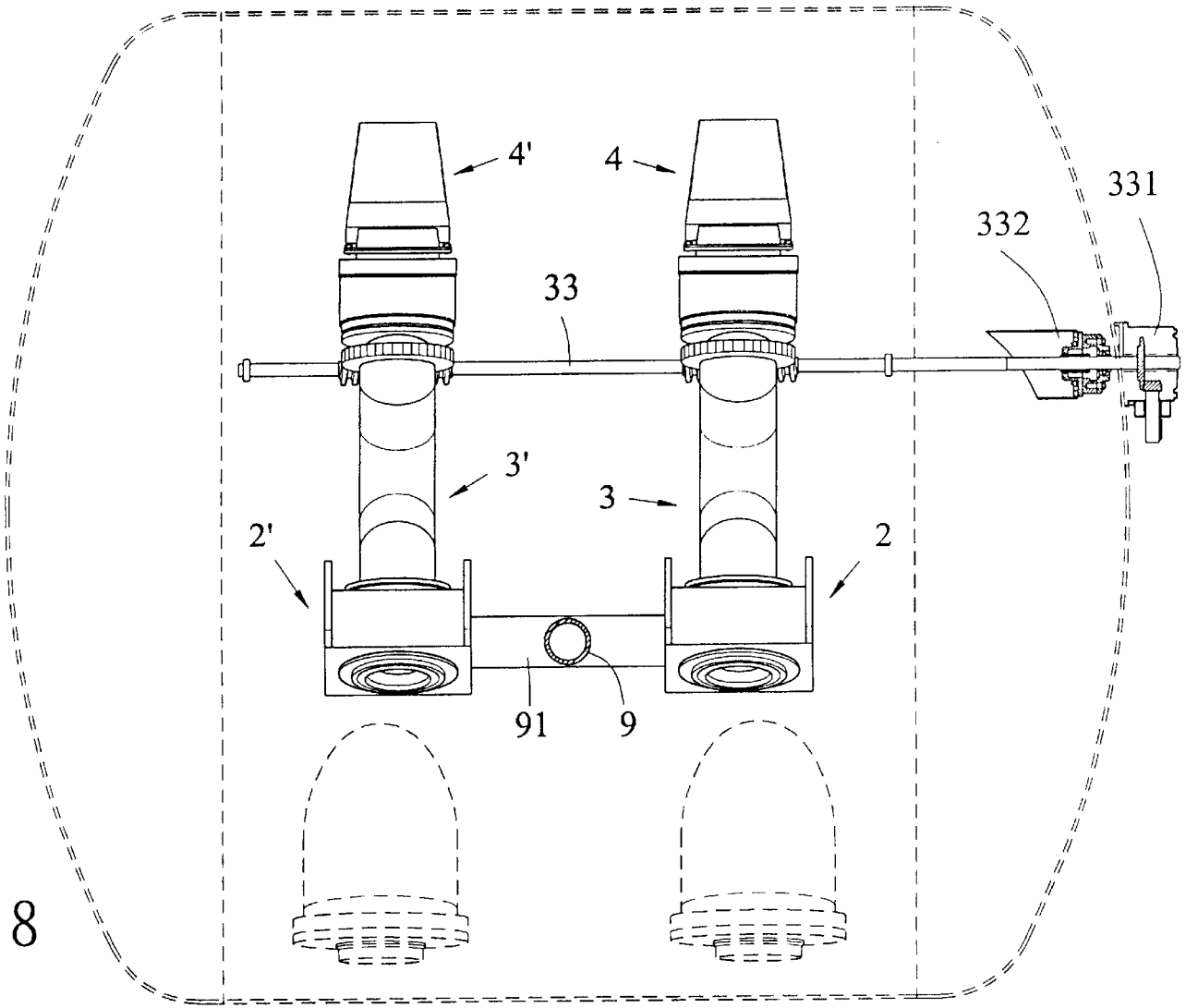
FIG. 8 is a schematic top plan view of a second preferred embodiment of dyeing machine according to the invention.
Figure 9:
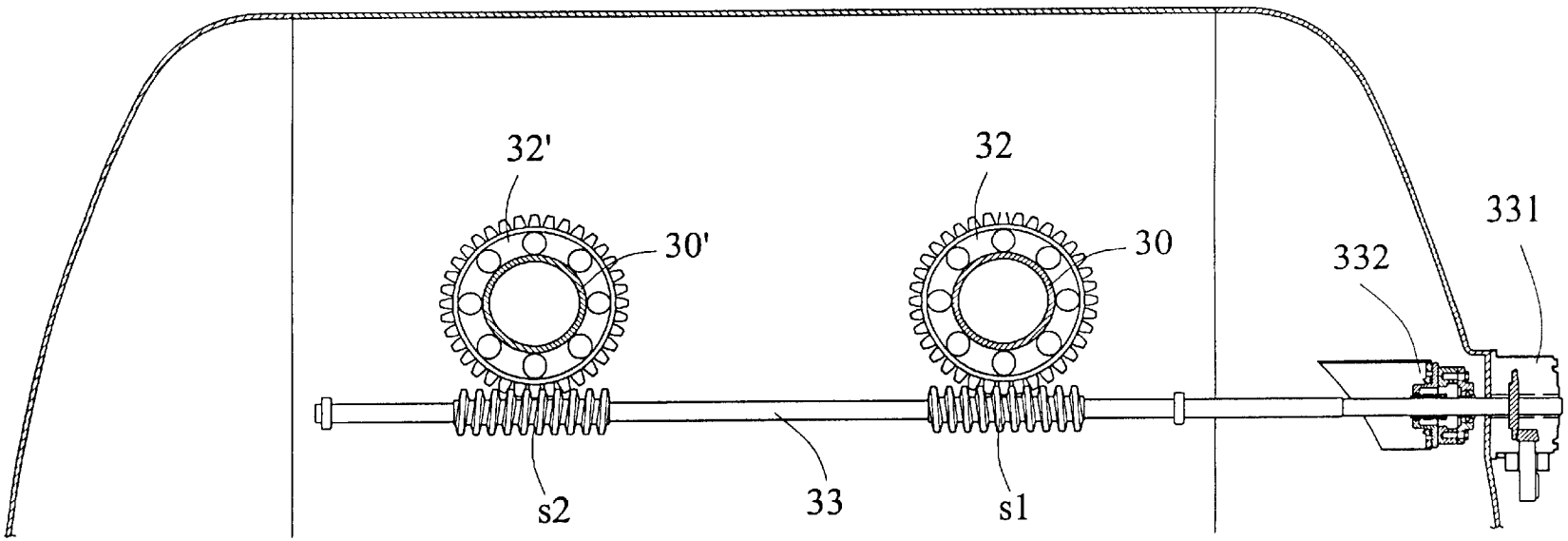
FIG. 9 is a sectional view of transmission mechanism shown in FIG. 8.

FIG. 8 is a second preferred embodiment of dyeing machine according to the invention. As shown, a double arrangement of nozzle mechanisms 2 and 2', fabric guide mechanisms 3 and 3', and fabric vibration mechanisms 4 and 4' is implemented. Also, supply line 9 is in fluid communication with a pipe 91 which feeds dye solution to both nozzle mechanisms 2 and 2'. FIG. 9 is a sectional view of transmission mechanism shown in FIG. 8. As shown, a pair of worm gears s1 and s2 are formed on shaft 33. Thus toothed wheel 32 (or 32') and fabric guide tube 30 (or 30') may be driven by worm gear s1 (or s2) when shaft 33 is rotated.

While the invention herein disclosed has been described by means of specific embodiments, numerous modifications and variations could be made thereto by those skilled in the art without departing from the scope and spirit of the invention set forth in the claims.

What is claimed is:

1. A dyeing machine comprising:

a roller mechanism (1) including a roller (10);

at least one nozzle mechanism (2) including a front nozzle device (20) and a rear nozzle device (40) both coupled to a common supply line (9); and at least one fabric guide mechanism (3) coupled to an end of a front joint (26) and a rear joint (46), said at least one fabric guide mechanism including a bent fabric guide tube (30), a front bearing (31), a joint (36) coupled to said front nozzle device (20), a rear toothed wheel (32), a flange seat (47), a flange threadedly (321) secured to said flange seat (47), and a shaft (33) engaged with and rotating said rear toothed wheel (32) for adjusting an angle of said fabric guide tube (30), a first sealing member (322) in said flange (321), a bearing housing (34) containing a plurality of rollers, a plate (35) fixed to said front joint (26), and a second sealing member (351) in said rear joint (46) wherein said bearing housing (34) is secured to said plate (35) to form a rotational mechanism; whereby orientation of the bent fabric guide tube (30) of the fabric guide mechanism (3) is moved downwardly to form a "V" to squeeze fabric (8) in the fabric guide tube (36); is moved upwardly to form an inverted "V" to impinge fabric (8) with a solution in the fabric guide tube (30); and is moved horizontally to loosen fabric (8) in the fabric guide tube (30).

2. The dyeing machine of claim 1, wherein said front nozzle device (20) comprises a front high pressure chamber (21) coupled to a front solution tube (25) which is also coupled to said rear nozzle device (40), a front nozzle tube (22) having a cone-shaped section (221), a front nozzle seat (23) having a cone-shaped member (231) to form the front nozzle device (20) by securing said front nozzle seat (23) to said front solution tube (25), thereby jetting a front stream of dye solution from said front nozzle device (20), and a front joint (26) having one end coupled to said front high pressure chamber (21).

3. The dyeing machine of claim 1, wherein said rear nozzle device (40) comprises a rear high pressure chamber (41) coupled to a rear solution tube (45) which is also coupled to said front nozzle device (20), a rear nozzle tube (42) having a cone-shaped section (421), a rear nozzle seat (43) having a cone-shaped member (431) to form the rear nozzle device by securing said rear nozzle seat (43) to said rear solution tube (45), thereby jetting a rear stream of dye solution from said rear nozzle device (40), a rear joint (46) coupled to a first side of said rear high pressure chamber (41), a flange seat (47) coupled to a second side of said rear high pressure chamber (41), and a fixing seat (422) at said rear nozzle tube (42).

4. The dyeing machine of claim 1, wherein said at least one nozzle mechanism (2) includes first and second nozzle mechanisms (2, 2') and said at least one fabric guide mechanism (3) includes first and second fabric guide mechanism (3, 3') and wherein the common supply line (9) is in fluid communication with a pipe (91) which feeds dye solution to both nozzle mechanisms (2, 2').

5. The dyeing machine of claim 4, further comprising a pair of worm gears (S1, S2) on said shaft (33), a pair of toothed wheels (32, 32') engaging said worm gears (S1, S2), and a pair of fabric guide tubes (30, 30') coupled to said toothed wheels (32, 32') so that each of said toothed wheels (32, 32') and said coupled fabric guide tubes (30, 30') are driven by said coupled worm gear (S1, S2) when said shaft (33) is rotated.

6. The dyeing machine of claim 1, further comprising a fabric vibration mechanism (4) having a rear bearing (48) fastened to said rear nozzle tube (42); a fabric separation mechanism (5) for separating fabric from dye solution, and including a fabric channel (50) and a storage area (51), a lower end of said rear nozzle tube (42) connected to an upper portion of the fabric channel (50) so that fabric (8) is sent through the fabric vibration mechanism (4) and into the fabric separating mechanism (5); a tension adjustment mechanism having an adjustment roller (60) for adjusting a tension between fabric (8) and the roller mechanism (1); and a bubble separation mechanism provided within the storage area (51) including a bubble reservoir (71) and a bubble outlet (72).

7. The dyeing machine of claim 1, wherein said roller is formed of stainless steel having a plurality of equally spaced detachable silicone strips formed therearound.

* * * * *